United States Patent [19]

Gejland et al.

[11] Patent Number: 4,972,645

[45] Date of Patent: Nov. 27, 1990

[54] DOOR FRAME AND A METHOD FOR PRODUCING AND MOUNTING SUCH A FRAME

[75] Inventors: Kjell Gejland; Anders Höglund, both of Vara, Sweden

[73] Assignee: Lindab Platisol AB, Sweden

[21] Appl. No.: 399,522

[22] PCT Filed: Feb. 29, 1988

[86] PCT No.: PCT/SE88/00089

§ 371 Date: Aug. 28, 1989

§ 102(e) Date: Aug. 28, 1989

[87] PCT Pub. No.: WO88/06670

PCT Pub. Date: Sep. 7, 1988

[30] Foreign Application Priority Data

Feb. 27, 1987 [SE] Sweden ..... 8700825

[51] Int. Cl.[5] ..... E06B 1/12

[52] U.S. Cl. ..... 52/211; 52/741

[58] Field of Search ..... 52/210, 213, 211, 214, 52/215, 217, 741, 745

[56] References Cited

U.S. PATENT DOCUMENTS

| | | | |
|---|---|---|---|
| 1,063,517 | 6/1913 | Ellis | 52/212 |
| 2,843,232 | 7/1958 | Goldberg | 52/211 |
| 3,363,371 | 1/1968 | Villalbos | 52/210 |
| 3,364,623 | 1/1968 | Sklar | 52/211 |
| 3,429,076 | 2/1969 | Fortsch | 52/211 |
| 3,552,085 | 1/1971 | Woodrun | 52/217 |
| 4,228,630 | 10/1980 | Englert | 52/211 |
| 4,513,549 | 4/1985 | Wendt | 52/211 |

*Primary Examiner*—John E. Murtagh

*Attorney, Agent, or Firm*—Ostrolenk, Faber, Gerb & Soffen

[57] ABSTRACT

The invention refers to a door frame produced from sheet metal profiles of mainly U-shaped cross section, which profiles form the top and side pieces of the frame. The purpose is to provide a simple and inexpensive door frame, which can be attached to partition walls of different types independent of their design and which frame by some simple manipulations is mounted and finished to a complete unit with architrave fillets. These tasks have been solved in that the side pieces are laterally cross-cut, that the sheet metal profile is designed and arranged between side shanks (16) of the profile to receive the wall portions (17) bordering a door opening (18), and that the top piece (11) and the side pieces (12) of the frame (10) within the corner portions on one hand are arranged to overlap each other and on the other hand are provided with means (20,21) for mutual interconnection by means of hooking into each other.

10 Claims, 4 Drawing Sheets

DOOR FRAME AND A METHOD FOR PRODUCING AND MOUNTING SUCH A FRAME

The present invention refers to a door frame manufactured from sheet metal profiles, which profiles form the top and side pieces of the frame, and which sheet metal profiles are designed and arranged in a manner to receive between the side shanks of the profile, wall portions adjacent to the door frame, whereby the top piece and the side pieces within the corner portions at one hand are arranged to over-lap each other and on the other hand are equipped with means for mutual interconnection.

BACKGROUND OF THE INVENTION

Door frames made of wood require besides a rather extensive mounting work also quite a lot of subsequent work, such as filling, painting, mounting of architraves for the door and painting and filling of these.

For partition walls consisting of plaster board on a steel metal stud frame there are specially produced door frames made of sheet metal, which are attached to the steel metal stud via cap profiles forming architraves. These give the wall a particular tone, which can be accepted in offices and similar environments, but hardly in dwelling houses.

SUMMARY OF THE INVENTION

The purpose of the present invention is to provide a simple and inexpensive door frame, which can be attached to partition walls of different types independent of their design and which frame by some simple manipulations is mounted and finished to a complete unit, with architrave fillets and without the necessity of filling and painting work. The mounting furthermore shall be so easy to accomplish that also a non-expert shall be able to mount the door frame. These tasks have been solved in that the side pieces are laterally cross-cut, that the end portions of the top piece are cut out in accordance with the shape of the associated side pieces, whereby the end portions of the side shanks of the side pieces are extended and adapted to overlap the corresponding side shanks of the end portions of the side pieces, that the connecting means comprises on one hand a downwardly deflected tongue, designed at the intermediate portion of the top piece and on the other hand a groove provided at the corresponding intermediate portion of the side portion, and that the portion immediately above the groove is offset in a direction obliquely inwards towards the shanks thereby forming an upwardly open passage.

BRIEF DESCRIPTION OF THE DRAWINGS

The invention will hereinafter be further described with reference to the accompanying drawings which show an embodiment.

DETAILED DESCRIPTION OF THE PREFERRED EMBODIMENT

Figure 1:
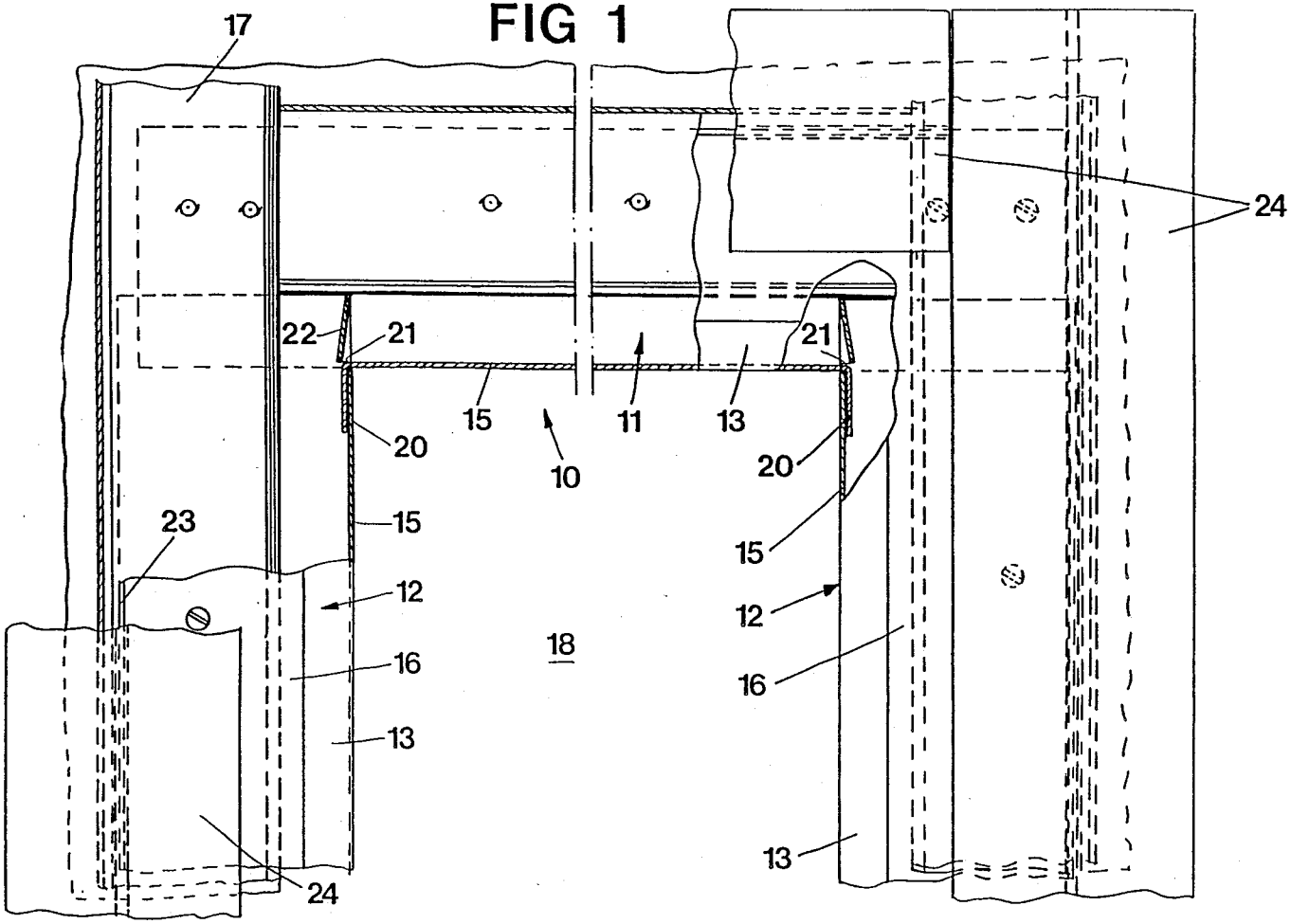
FIG. 1 shows the upper part of a door frame in accordance with the invention as seen from the front and partly in cross section.
Figure 2:
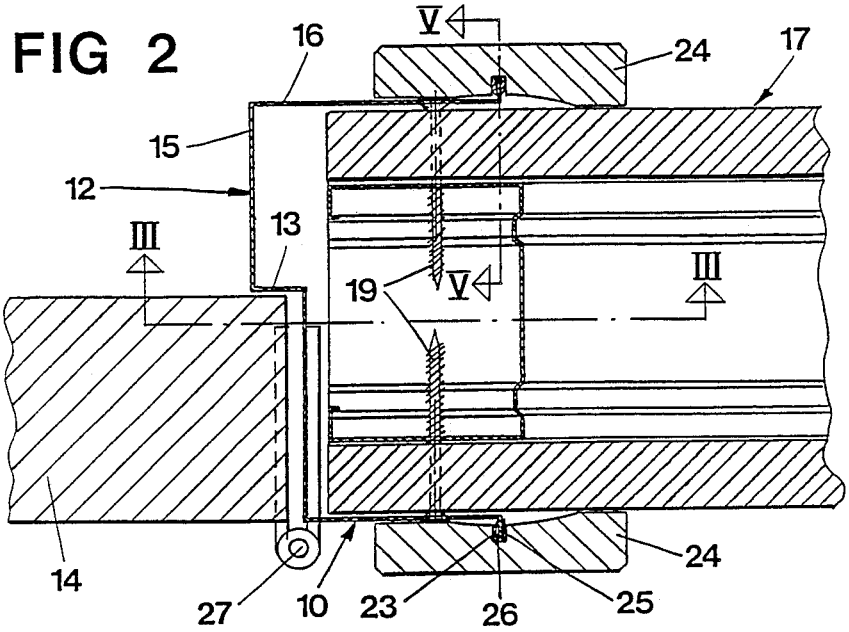
FIG. 2 shows a section along line II—II in FIG. 1.
Figure 3:
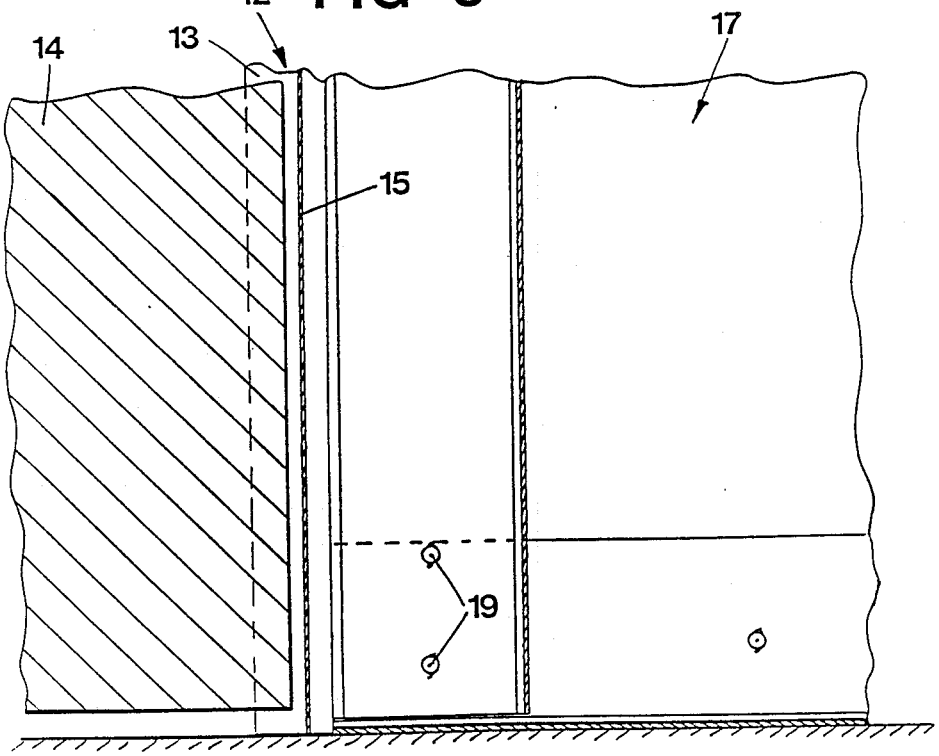
FIG. 3 is a section along line III—III in FIG. 2.

The door frame 10 according to the invention consists of a sheet metal profile having a mainly U-shaped cross section and which profile is subdivided into a top piece 11 and two side pieces 12. The door frame profile in conventional manner is provided with a stop edge 13 for a door leaf 14, which stop edge is arranged in the intermediate portion 15 of the U-shaped profile between its shanks 16. The profile furthermore is designed so that between the shanks 16 can be received the wall portion 17, which borders the door opening 18, such as shown in FIG. 2, and to which wall portion the sheet metal profile is attached by means of proper means 19, which e.g. can be self-tapping screws.

Figure 4:
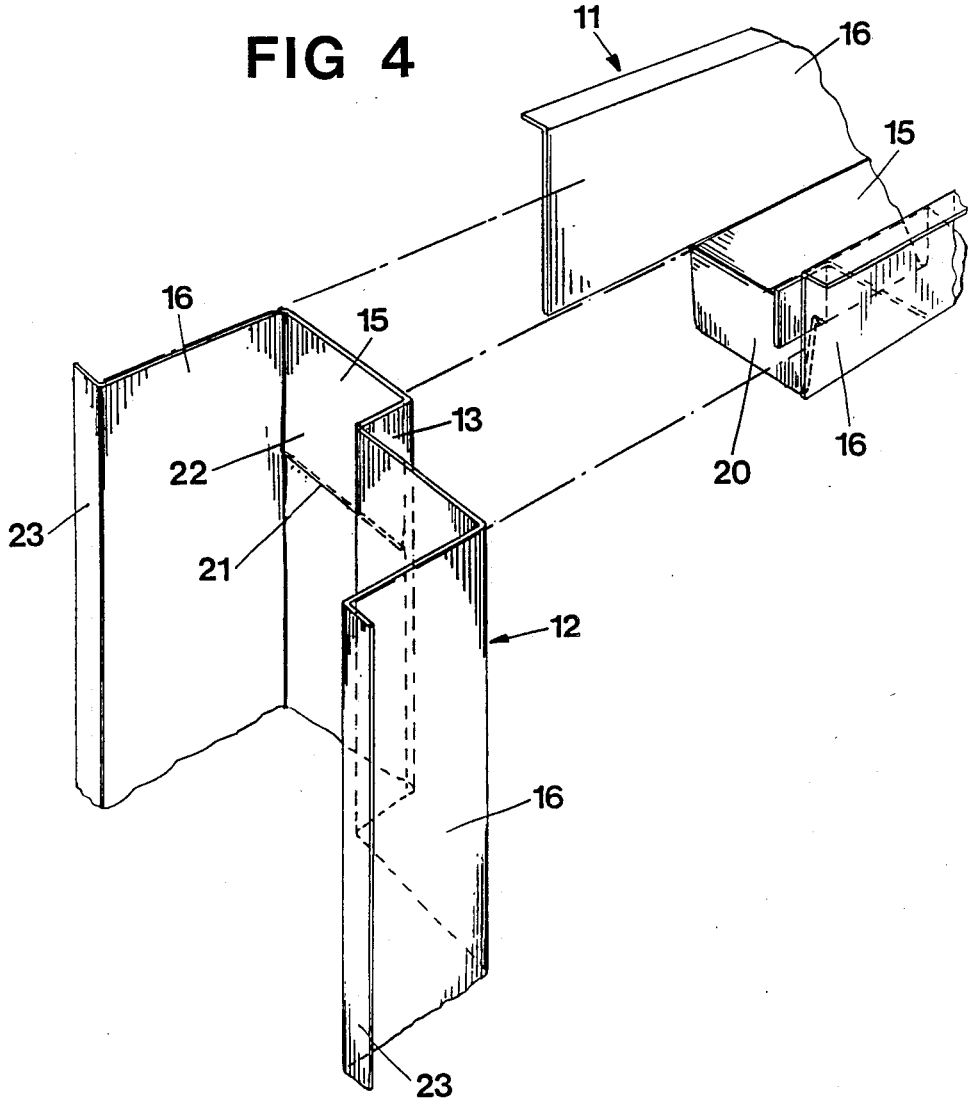
FIG. 4 shows in perspective two end portions of top piece and side piece of the frame, which pieces together form one corner connection of the frame.
Figure 7:
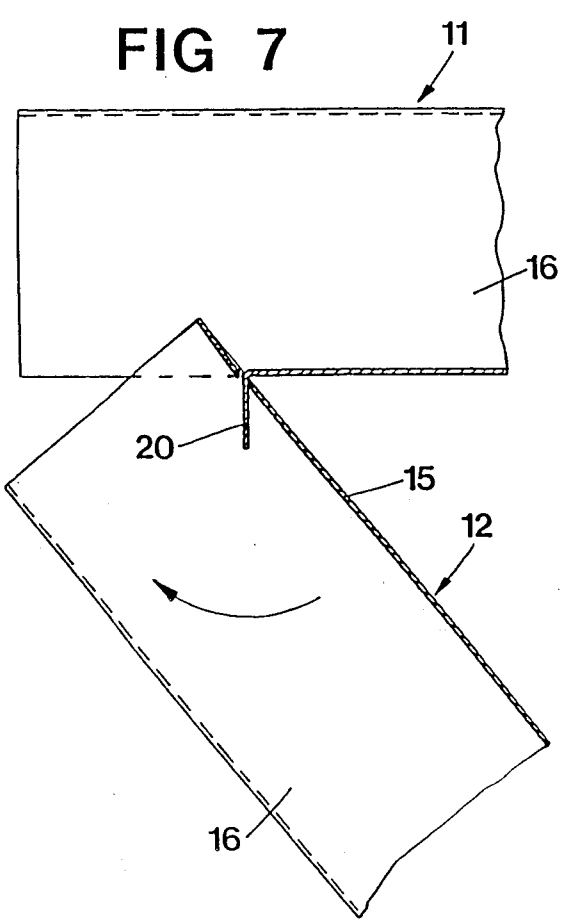
FIGS. 6 and 7 show sections through end portions of the top piece and side piece during the mounting operation.
Figure 6:
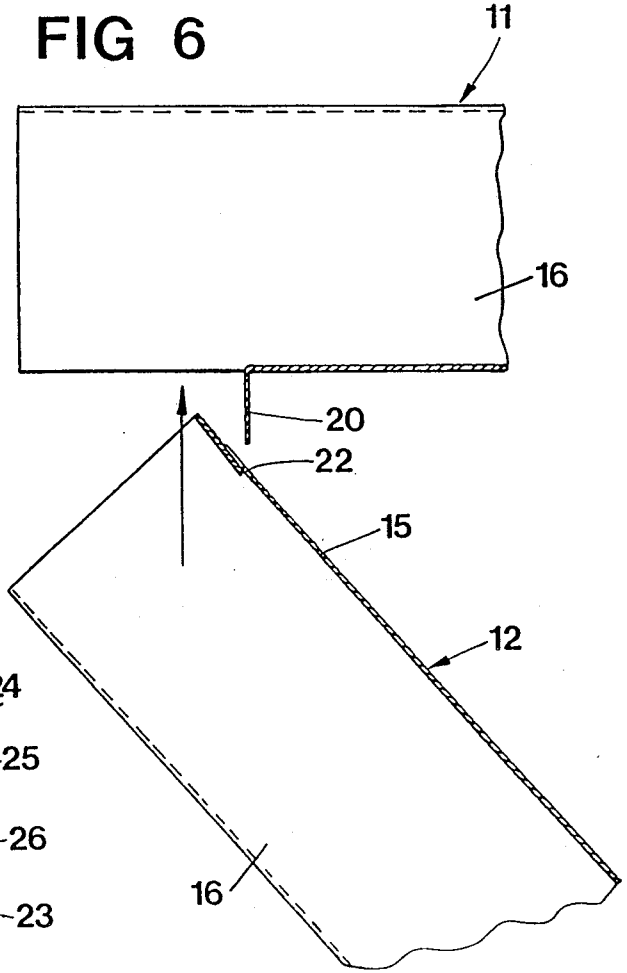
Figure 5:
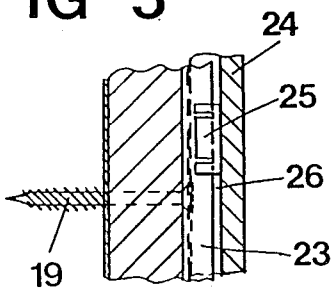
FIG. 5 is a section along line V—V in FIG. 2.

The side pieces 12 of the frame 10 has a length exceeding the height of the door opening 18 with half a shank length, and which side pieces are cut off at right angle to their longitudinal axes. The end portions of the top piece 11 however are cut out, thus that they obtain a shape complementary to the shape of the side pieces, such as shown in FIG. 4, whereby in the intermediate portion 15 of the top piece between the shanks 16 is formed a tongue 20, which is bent substantially at right angle to the intermediate portion 15. In the side piece 12 just in front of the intermediate portion 15 of the top piece there is arranged a groove 21, intended to receive the tongue 20 of the top piece. The groove 21 is formed in that the material portion 22 immediately above the groove 21 is bent inwards in a direction away from the intermediate portion 15, thus that the introduction of the tongue 20 is facilitated.

The sheet metal profile furthermore at the free ends of the shanks 16 is provided with longitudinal flanges 23, bent at an angle, which flanges serve as attachments for architrave fillets 24, which surround the door frame 10. The attachment of the architrave fillets 24 is effected with aid of clips 25 that can be clamped upon the flanges 23 and which clips are provided with barbs similar to stops, which are insertable into a longitudinal groove 26 in the architrave fillets 24.

The production and mounting of the door frame is accomplished in the following manner. The top and side pieces 11 and 12 have been shaped in accordance with what is shown in FIG. 4 by means of a suitable punching tool. One of the side pieces thereupon is hooked onto the top piece 11 by inserting the tongue 20 into the groove 21. These two interconnected profiles are thereupon located in the door opening in their positions, and the other side piece is hooked into the opposite end of the top piece, which is possible in that the groove 21 has a vertical opening. The sheet metal profiles are thereupon attached provisionally to the wall 17 and the door leaf is fitted on the hinges 27, whereupon the final adjustment of the frame is made and the frame is permanently attached to the wall 17.

The invention is not limited to the embodiment described but a plurality of variants are possible within the scope of the claims.

I claim:

1. A door frame, comprising:

an elongated top piece, an elongated first side piece and an elongated second side piece, each of the pieces being manufactured from profiled sheet material, each of the pieces having a generally U-shaped cross section formed by side shanks and an intermediate portion, the side shanks of the top and side pieces overlapping each other;

the intermediate portion of the first side piece including an upwardly open passage, the open passage being formed by an offset portion which is directed obliquely toward the side shanks of the first side piece;

the intermediate portion of the second side piece including an upwardly open passage, the open passage of the second side piece being formed by an offset portion which is directed obliquely toward the side shanks of the second side piece;

the top piece including first and second tongues which extend downwardly from the intermediate portion of the top piece, the tongues connecting the top piece to the side pieces by extending downwardly through the upwardly open passages.

2. The door frame of claim 1, wherein the top piece and the side pieces are metal.

3. The door frame of claim 1, wherein the side shanks of each of the top and side pieces are spaced apart so as to fit over edges of a wall.

4. The door frame of claim 3, wherein the top piece has end portions which are cut out to conform to the generally U-shaped cross section of the side pieces.

5. The door frame of claim 4, wherein the first and second side pieces have top end portions, the side shanks of the top piece overlapping the top end portions of the side pieces.

6. The door frame of claim 5, wherein the top and side pieces include flanges for attaching architrave fillets to the door frame, the flanges being bent outwardly at an angle from the side shanks of the top and side pieces.

7. The door frame of claim 6, wherein the intermediate portions of the top and side pieces include stop edges for stopping a door leaf within the door frame.

8. The door frame of claim 7, further comprising a hinge for supporting the door leaf within the door frame, the hinge being connected to the first side piece.

9. A method of making a door frame, comprising the steps of:

providing an elongated top piece, an elongate first side piece and an elongated second side piece, each of the pieces being manufactured from profiled sheet material, each of the pieces having a generally U-shaped cross section formed by side shanks and an intermediate portion, the top piece including first and second tongues which extend downwardly from the intermediate portion of the top piece, each of the intermediate portions of the side pieces including upwardly open passages;

arranging the top piece and the first side piece such that the top piece and the first side piece are at an acute angle with respect to one another;

while the top piece and the first side piece are at an acute angle, interconnecting the top piece and the first side piece by positioning the first tongue within the upwardly open passage of the first side piece;

arranging the top piece and the second side piece such that the top piece and the second side piece are at an acute angle with respect to one another; and while the top piece and the second side piece are at an acute angle, interconnecting the top piece and the second side piece by positioning the second tongue within the upwardly open passage of the second side piece.

10. The method of claim 9, wherein the upwardly open passage of the first side piece is formed by an offset portion which is directed obliquely toward the side shanks of the first side piece.

* * * * *